US010001248B2

(12) United States Patent
Qin et al.

(10) Patent No.: US 10,001,248 B2
(45) Date of Patent: Jun. 19, 2018

(54) LIGHT BAR

(71) Applicant: GE Lighting Solutions, LLC, East Cleveland, OH (US)

(72) Inventors: Hexi Qin, ShangHai (CN); Xiaoning Wang, Xi'an (CN); Eden Dubuc, Lachine (CA); Jeffrey Marc Nall, Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 120 days.

(21) Appl. No.: 14/932,290

(22) Filed: Nov. 4, 2015

(65) Prior Publication Data

US 2016/0131311 A1 May 12, 2016

(30) Foreign Application Priority Data

Nov. 12, 2014 (CN) ..... 2014 2 0673204 U

(51) Int. Cl.
*F21K 99/00* (2016.01)
*F21S 4/28* (2016.01)
(Continued)

(52) U.S. Cl.
CPC ..... *F21K 9/17* (2013.01); *A47F 3/001* (2013.01); *A47F 3/0491* (2013.01);
(Continued)

(58) Field of Classification Search
CPC ..... F21K 9/17; F21K 9/27; F21S 4/28; A47F 3/001; A47F 3/0491; A47F 7/0071;
(Continued)

(56) References Cited

U.S. PATENT DOCUMENTS 7,559,672 B1 * 7/2009 Parkyn ..... A47B 97/00 362/127
7,934,701 B2 5/2011 Kay
(Continued)

FOREIGN PATENT DOCUMENTS

DE 10 2011 106252 A1 1/2013
EP 2 233 831 A1 9/2010
(Continued)

OTHER PUBLICATIONS

Extended European Search Report and Opinion issued in connection with corresponding EP Application No. 15193051.8 dated Feb. 29, 2016.

(Continued)

*Primary Examiner* — Bao Q Truong
(74) *Attorney, Agent, or Firm* — Peter T. DiMauro; GE Global Patent Operation

(57) ABSTRACT

A light bar and a refrigeration display using the light bar are disclosed. The light bar includes an optical component, a housing for reflecting light and a substrate assembly. The optical component and the housing together form a tube with a cavity. The substrate assembly is held in the cavity and includes a substrate and a plurality of LED light sources mounted on at least one side of the substrate. Light emitted from the plurality of LED light sources is irradiated to at least one predetermined area perpendicular to the substrate after passing through the optical component.

10 Claims, 8 Drawing Sheets

(51) Int. Cl.

| | |
|---|---|
| ***A47F 3/00*** | (2006.01) |
| ***A47F 3/04*** | (2006.01) |
| ***A47F 7/00*** | (2006.01) |
| ***F21V 7/00*** | (2006.01) |
| ***F21V 11/00*** | (2015.01) |
| ***F21K 9/27*** | (2016.01) |
| *F21V 11/16* | (2006.01) |
| *F21W 131/405* | (2006.01) |
| *F21Y 103/10* | (2016.01) |
| *F21Y 115/10* | (2016.01) |
| *F21Y 107/90* | (2016.01) |
| *F21V 5/04* | (2006.01) |

(52) U.S. Cl.
CPC ..... *A47F 7/0071* (2013.01); *F21K 9/27* (2016.08); *F21S 4/28* (2016.01); *F21V 7/005* (2013.01); *F21V 11/00* (2013.01); *F21V 5/04* (2013.01); *F21V 11/16* (2013.01); *F21W 2131/405* (2013.01); *F21Y 2103/10* (2016.08); *F21Y 2107/90* (2016.08); *F21Y 2115/10* (2016.08)

(58) Field of Classification Search
CPC ..... F21V 7/005; F21V 11/00; F21V 11/16; F21Y 2107/90; F21Y 2103/10; F21Y 2115/10; F21W 2131/405
See application file for complete search history.

(56) References Cited

U.S. PATENT DOCUMENTS

| | | | | |
|---|---|---|---|---|
| 8,579,462 | B2 * | 11/2013 | VanDuinen | F21V 19/0045 362/217.02 |
| 9,169,977 | B2 * | 10/2015 | Medendorp, Jr. | F21K 9/17 |
| 9,441,816 | B2 * | 9/2016 | Van Gompel | F21V 19/004 |
| 2009/0002990 | A1 | 1/2009 | Becker et al. | |
| 2011/0058357 | A1 * | 3/2011 | Anderson | A47F 3/001 362/125 |
| 2011/0084627 | A1 | 4/2011 | Sloan et al. | |
| 2011/0235318 | A1 * | 9/2011 | Simon | F21S 4/008 362/217.05 |

FOREIGN PATENT DOCUMENTS

| | | | |
|---|---|---|---|
| WO | 2011/019753 | A1 | 2/2011 |
| WO | 2013/004608 | A1 | 1/2013 |

OTHER PUBLICATIONS

Office Action issued in connection with corresponding MX Application No. MX/A/2015/015629 dated Jun. 13, 2017.
Mexico Office Action issued in connection with corresponding MX Application No. MX/A/2015/015629 dated Jan. 30, 2018.

* cited by examiner

LIGHT BAR

BACKGROUND

This disclosure relates generally to a light fixture, and more particularly to a light bar for illuminating a product display area and used in a display cabinet.

In conventional practice, commercial establishments such as supermarkets, convenience stores, delis and fast food restaurants are usually equipped with refrigeration displays. The refrigeration displays may be open or provided with doors and are used for presenting perishable food or beverages to customers while maintaining the fresh food or beverages in a refrigerated environment. Typically, the refrigeration displays include a light bar to illuminate a product display area for better marketing of the food product and for higher visibility of the customers.

The light bars of the conventional refrigeration displays typically use a fluorescent light source to illuminate the product display area. In some refrigeration displays, the fluorescent light sources are coupled to a canopy of the refrigeration display to direct light generally downward onto the food product in the product display area. In some refrigeration displays, the fluorescent light sources may also be attached to shelves in the product display area. However, the fluorescent light sources used in the conventional refrigeration displays are relatively large.

Light emitting diode (LED) light sources are becoming more prevalent as replacements for the conventional light sources such as the fluorescent light source. The LED light sources are widely applied to the illumination system because they have such many advantages as small size, low power consumption, longer lifetime, high luminous efficiency, fast response and etc.

However, the light bar using the LED light sources in the conventional refrigeration display is usually very complex in structure, resulting in higher product cost.

BRIEF DESCRIPTION

In one aspect of embodiments of the present invention, a light bar is provided. The light bar comprises an optical component, a housing for reflecting light and a substrate assembly. The optical component and the housing together form a tube with a cavity. The substrate assembly is held in the cavity and comprises a substrate and a plurality of LED light sources mounted on at least one side of the substrate. Light emitted from the plurality of LED light sources is irradiated to at least one predetermined area perpendicular to the substrate after passing through the optical component.

In another aspect of embodiments of the present invention, a refrigeration display is provided. The refrigeration display comprises a plurality of shelves for holding product, at least one mullion having a mounting surface and a vertically extending light bar positioned within the interior of the refrigeration display behind the at least one mullion and forward of the shelves. The light bar comprises an optical component, a housing for reflecting light and a substrate assembly. The optical component and the housing together form a tube with a cavity. The substrate assembly is slidably held in the cavity and comprises a substrate perpendicular to the mounting surface of the at least one mullion and a plurality of LED light sources mounted on at least one side of the substrate. Light emitted from the plurality of LED light sources is irradiated to the shelves after passing through the optical component.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
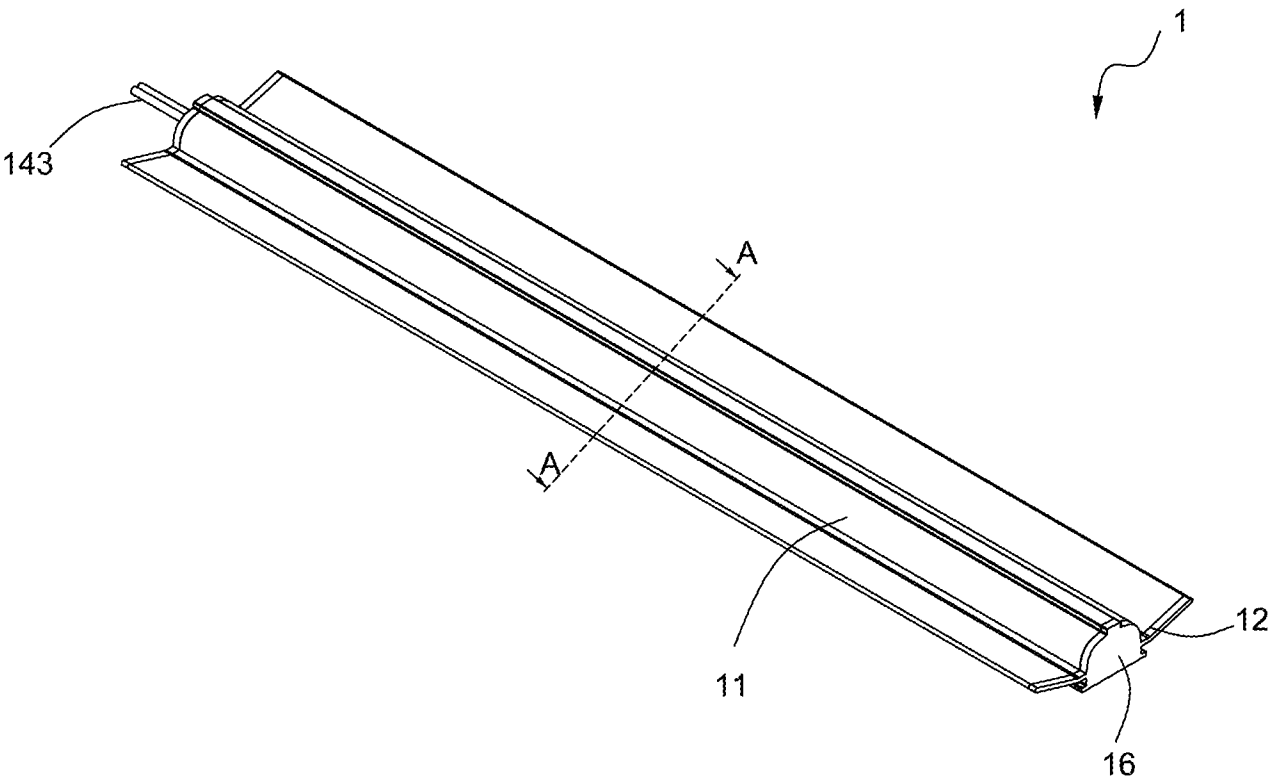
FIG. 1 is a schematic assembled view of a light bar in accordance with a first embodiment of the present invention.

Embodiments of the present disclosure will be described hereinbelow with reference to the accompanying drawings. In the following description, well-known functions or constructions are not described in detail to avoid obscuring the disclosure in unnecessary detail.

Unless defined otherwise, technical and scientific terms used herein have the same meaning as is commonly understood by one of ordinary skill in the art to which this disclosure belongs. The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean either or all of the listed items. The use of "including," "comprising" or "having" and variations thereof herein are meant to encompass the items listed thereafter and equivalents thereof as well as additional items.

FIGS. 1-4 illustrate schematic diagrams of a light bar in accordance with a first embodiment of the present invention. As shown in FIGS. 1 to 4, the light bar in accordance with the first embodiment of the present invention includes an optical component 11, a housing 12 for reflecting light and a substrate assembly 14. The optical component 11 and the housing 12 extend longitudinally, and the optical component 11 and the housing 12 together form a tube 10 with a cavity 13. The substrate assembly 14 is held in the cavity 13 of the tube 10 and comprises a substrate 141 and a plurality of LED light sources 142 mounted on the substrate 141. Light emitted from the plurality of LED light sources 142 can be irradiated to at least one predetermined area perpendicular to the substrate 141 after passing through the optical component 11.

The light bar 1 of the first embodiment is simple in structure and easy to assemble and has lower manufacturing cost. Furthermore, the light bar 1 can adopt multiple low power LED light sources 142, thereby further reducing product cost.

The optical component 11 may be refractive or act as a lens, or the optical component 11 may be simply transmissive or translucent. The optical component 11 may be comprised of transparent or translucent polycarbonate, for example, or any other thermoplastic material which is transparent or translucent in operation, and which may be capable of being extruded or injection molded.

The housing 12 may be an opaque or diffusive component which generally blocks the transmission of light. In one embodiment, the housing 12 may be made from a reflective material. In another embodiment, the housing 12 may also be made from a light-transmitting material which is covered by a layer of light-blocking material. For example, the housing 12 may made from a transparent material covered with a layer of opaque material. The housing 12 may also be comprised of a polycarbonate material, which comprises additives that make it opaque or diffusive. Alternatively, the opaque or diffusive component acting as the housing 12 may comprise other thermoplastic materials which do not pass light. Generally, the housing 12 may also be capable of being extruded or injection molded.

In a preferable embodiment, the optical component 11 and the housing 12 may be made of suitably compatible thermoplastics, so the optical component 11 and the housing 12 may be made by a co-injection process or a co-extrusion process. By this way, the optical component 11 and the housing 12 are integrated together to form the tube 10 with the cavity 13. For example, the optical component 11 and the housing 12 are both made of polycarbonate, one is transparent or translucent, and the other is made to not be transparent or translucent, which may facilitate fabrication by a co-injection process or a co-extrusion process. Alternatively, the optical component 11 and the housing 12 can also be made of different kinds of thermoplastic materials.

Figure 2:
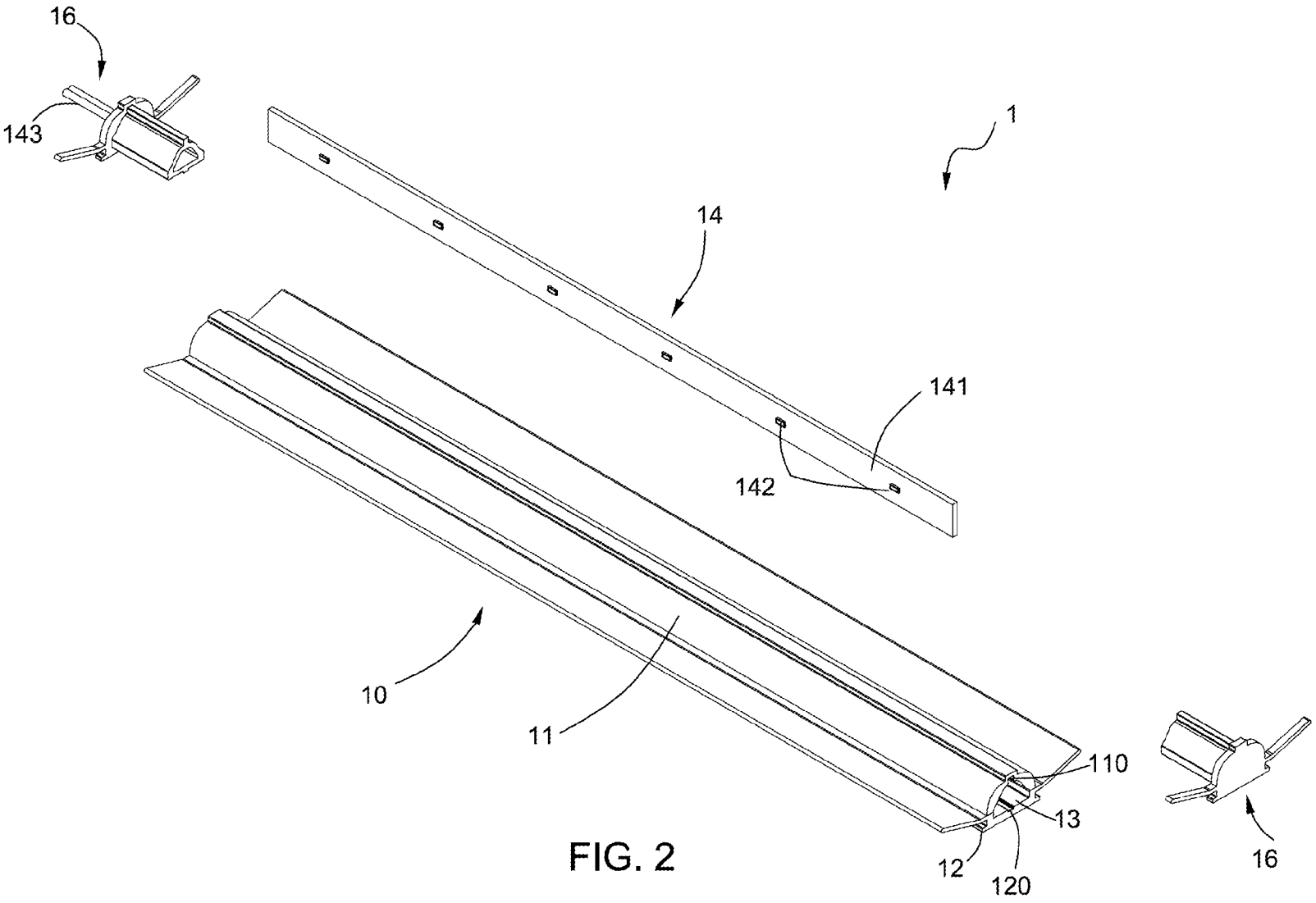
FIG. 2 is a schematic exploded view of the light bar of FIG. 1.
Figure 3:
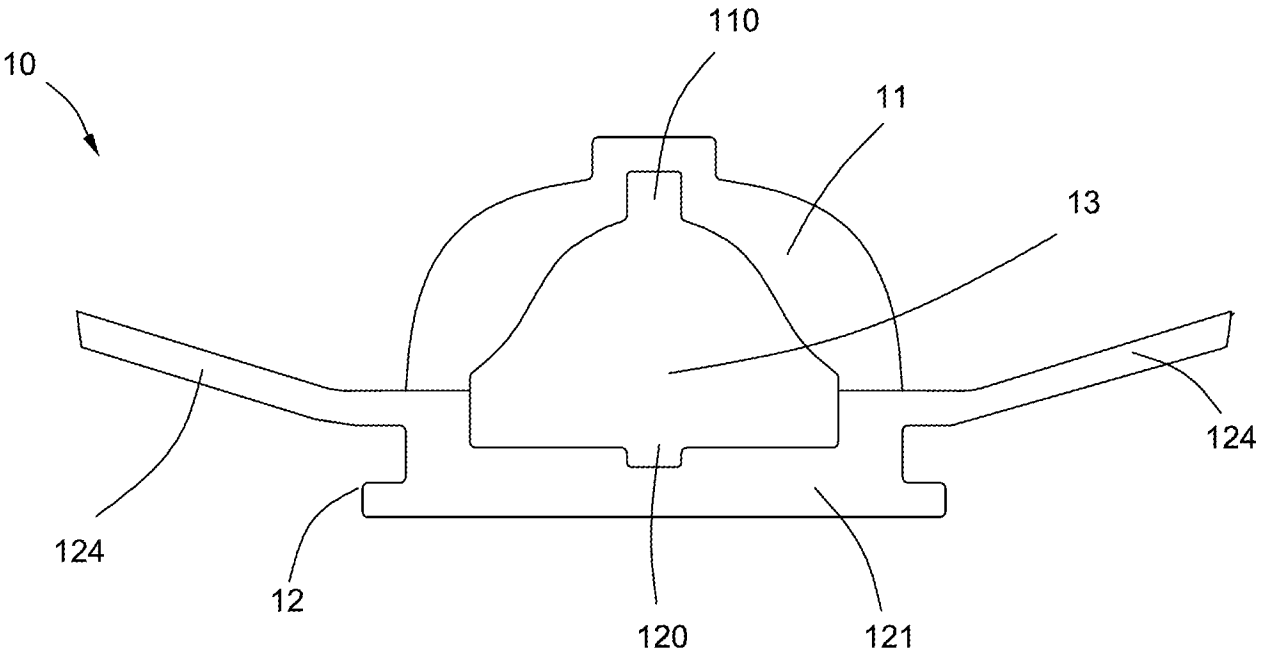
FIG. 3 is an enlarged view of an end portion of a tube of FIG. 2.
Figure 4:
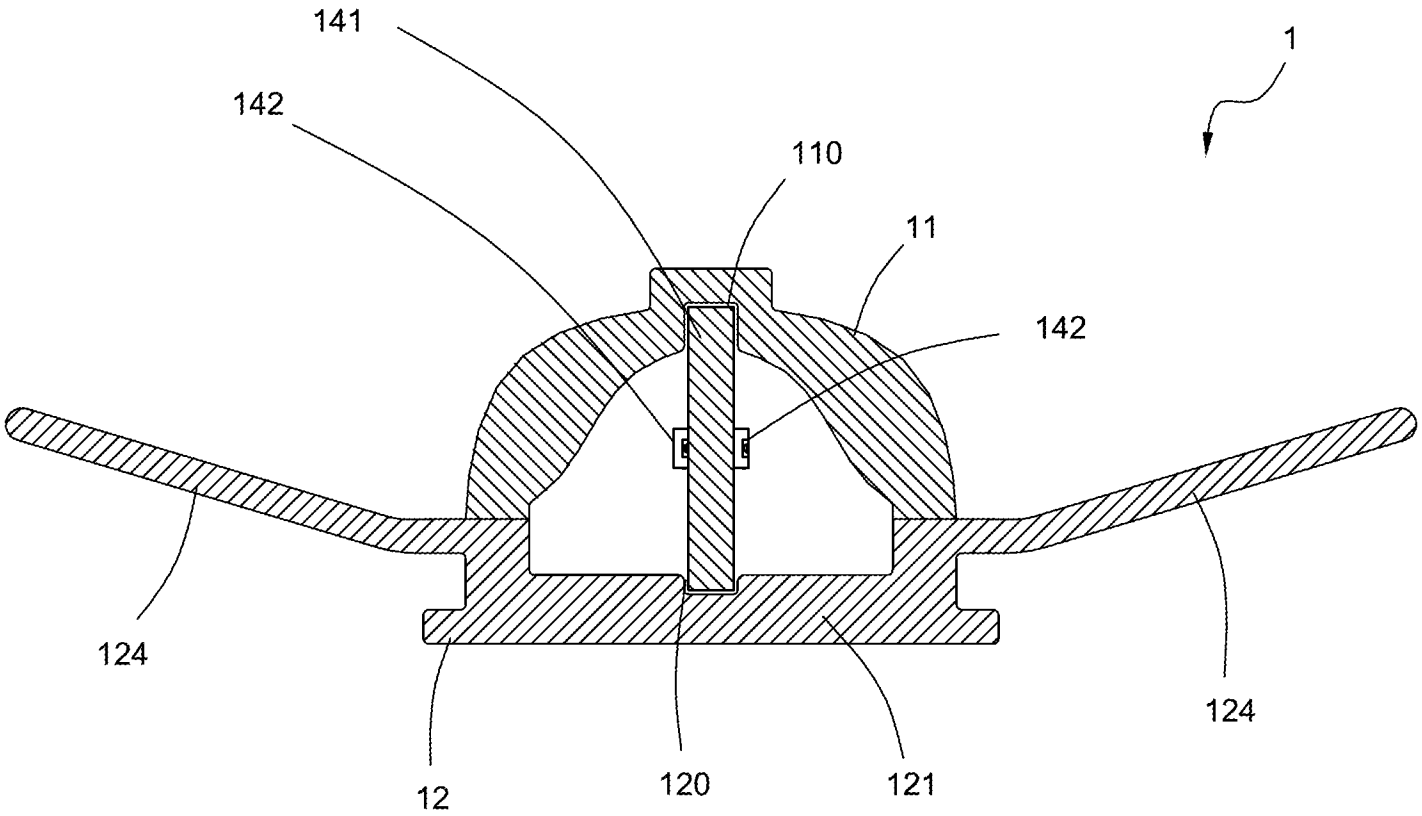
FIG. 4 is a cross-sectional view of the light bar of FIG. 1 taken along the line A-A.
Figure 5:
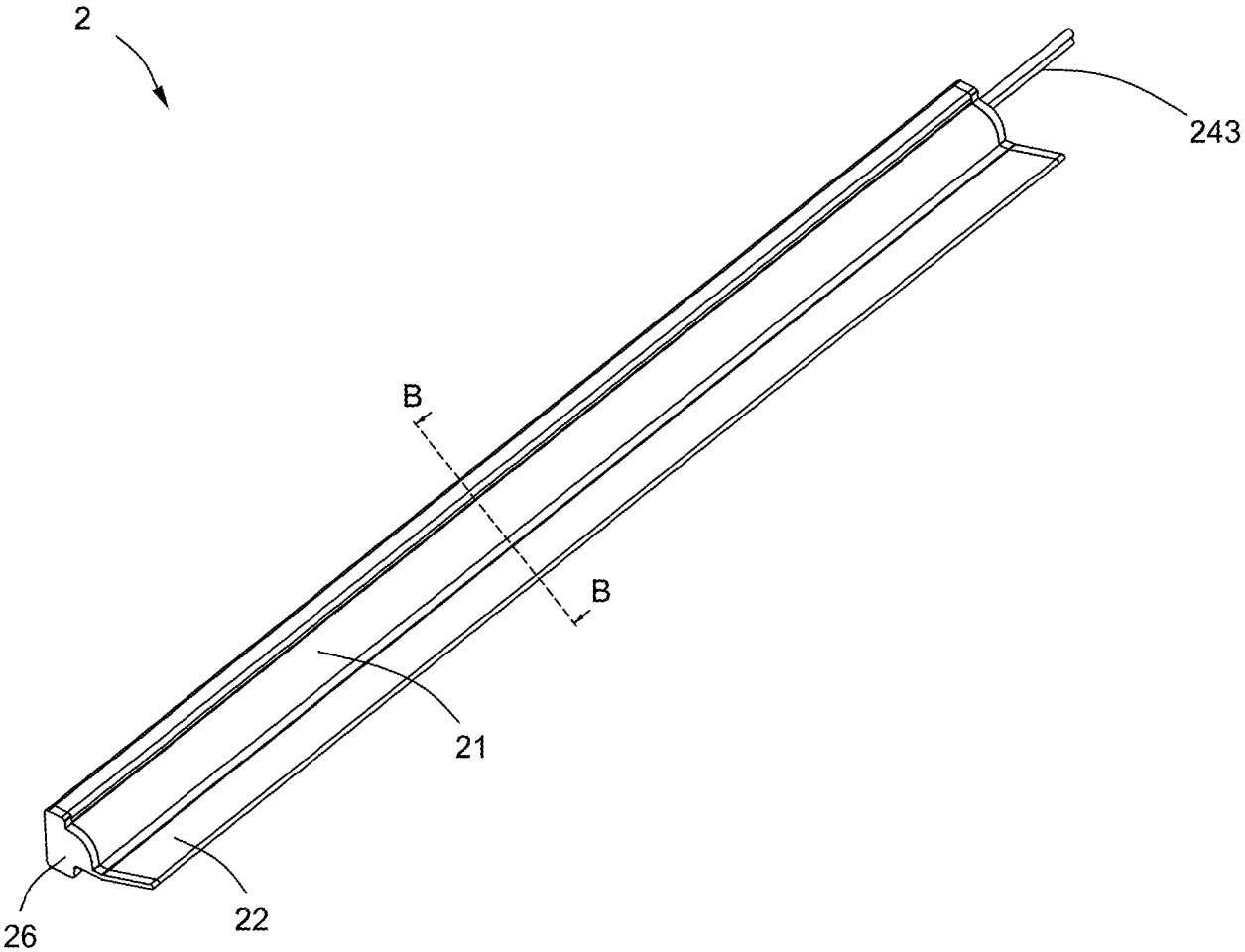
FIG. 5 is a schematic assembled view of a light bar in accordance with a second embodiment of the present invention.

With reference to FIGS. 2-4, the housing 12 comprises a mounting wall 121 substantially extending longitudinally. The mounting wall 121 of the housing 12 is configured to be mounted onto a mullion of a display cabinet (not shown) so that the light bar 1 is fixed onto the mullion of the display cabinet. The substrate assembly 14 is slidably and perpendicularly mounted in the mounting wall 121 of the housing 12 so as to distribute the light emitted from the plurality of LED light sources 142 wider and easier.

The substrate 141 has the shape of a slab. The slab-shaped substrate 141 has opposite two sides. In this embodiment, the substrate 141 is for example a printed circuit board (PCB). Certainly, the substrate 141 of the present invention should be not limited to the PCB.

Referring to FIGS. 2 and 4, in the first embodiment of the present invention, the plurality of LED light sources 142 are mounted on opposite two sides of the substrate 141, and the light emitted from the plurality of LED light sources 142 can be irradiated to opposite two predetermined areas after passing through the optical component 11.

In this embodiment, the light bar 1 has two halves which are symmetrical relative to the substrate 141. So the optical component 11 has two halves which are symmetrical relative to the substrate 141 and the housing 12 also has two halves which are symmetrical relative to the substrate 141. In an embodiment, the optical component 11 has a substantially dome-shaped cross-section. Each of the two halves of the optical component 11 has different thickness. The optical component 11 can control the light emitted from the plurality of LED light sources 142 to shine a surface perpendicular to a substrate direction. The shape of the cross-section of the optical component 11 can be properly changed according to user's requirements so that the light emitted from the plurality of LED light sources 142 can be irradiated to a desired display area.

As shown in FIGS. 2 and 3, the optical component 11 defines a first longitudinal channel 110 at a junction of the two halves thereof and the housing 12 defines a second longitudinal channel 120 at a junction of the two halves thereof. The substrate assembly 14 is slidably mounted between the first longitudinal channel 110 of the optical component 11 and the second longitudinal channel 120 of the housing 12 so that the substrate assembly 14 is held in the cavity 13 of the tube 10.

In an optional embodiment, the housing 12 may further comprise a pair of anti-dazzle wings 124 extending from opposite two lateral sides of the mounting wall 121 beyond the optical component 11. The pair of wings 124 can block light from the optical component 11 to enter eyes of the user who is on the side of the housing 12, which brings the user better visual effects.

With reference to FIG. 3, the light bar 1 further comprises a pair of end caps 16 attached to ends of the tube 10 for sealing the cavity 13. One of the pair of end caps 16 defines a hole (not shown) therein and the substrate assembly 14 further comprises a wire harness 143 connecting with the substrate 141. The wire harness 143 extends out of the tube 10 through the hole of the end cap 16 for connecting to an external controlling circuit. The end cap 16 has a matching structure with the tube 10 so that the light bar 1 has a uniform appearance.

In assembly, the plurality of LED light sources 142 are first mounted on the substrate 141 to form the substrate assembly 14. Then the substrate 141 with the plurality of LED light sources 142, i.e. the substrate assembly 14 is inserted to the cavity 13 of the tube 10 and slidably held between the first longitudinal channel 110 of the optical component 11 and the second longitudinal channel 120 of the housing 12. Finally, the pair of end caps 16 are attached to the ends of the tube 10. The assembly of the light bar 1 is easily finished.

FIGS. 5-8 illustrate schematic diagrams of a light bar in accordance with a second embodiment of the present invention. Similar to the light bar 1 of the first embodiment, as shown in FIGS. 5 to 8, the light bar 2 in accordance with the second embodiment also includes an optical component 21, a housing 22 for reflecting light and a substrate assembly 24. The optical component 21 and the housing 22 together form a tube 20 with a cavity 23. The substrate assembly 24 is held in the cavity 23 of the tube 20 and comprises a substrate 241, a plurality of LED light sources 242 mounted on the substrate 241, and a wire harness 243 connecting with the substrate 241. In a preferable embodiment, the optical component 21 and the housing 22 are integrated together to form the tube 20 with the cavity 23 by a co-injection process or a co-extrusion process.

The optical component 21 has different thickness. The optical component 21 can control the light emitted from the plurality of LED light sources 242 to shine a surface perpendicular to a substrate direction. The shape of the cross-section of the optical component 21 can be properly changed according to user's requirements so that the light emitted from the plurality of LED light sources 242 can be irradiated to a desired display area.

Figure 6:
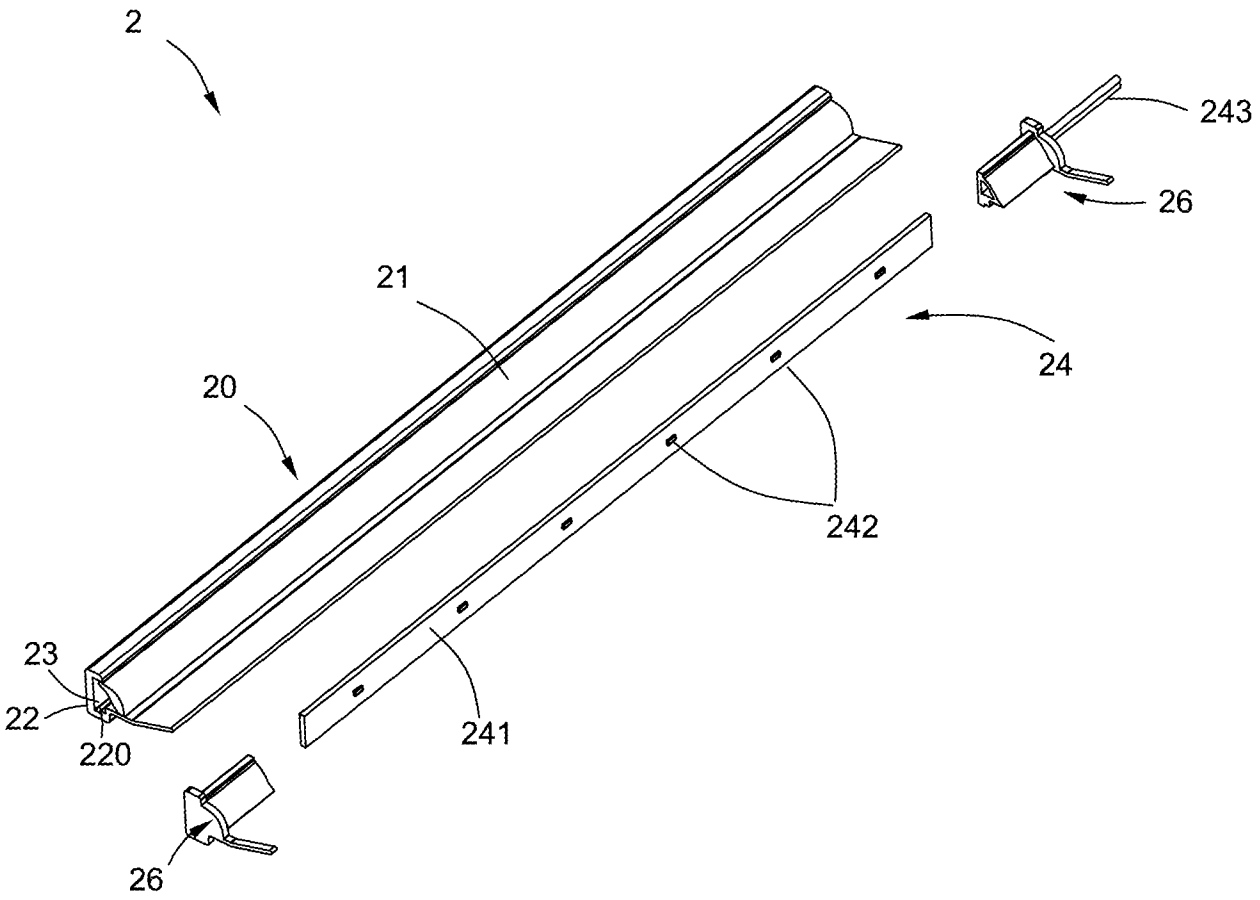
FIG. 6 is a schematic exploded view of the light bar of FIG. 5.
Figure 8:
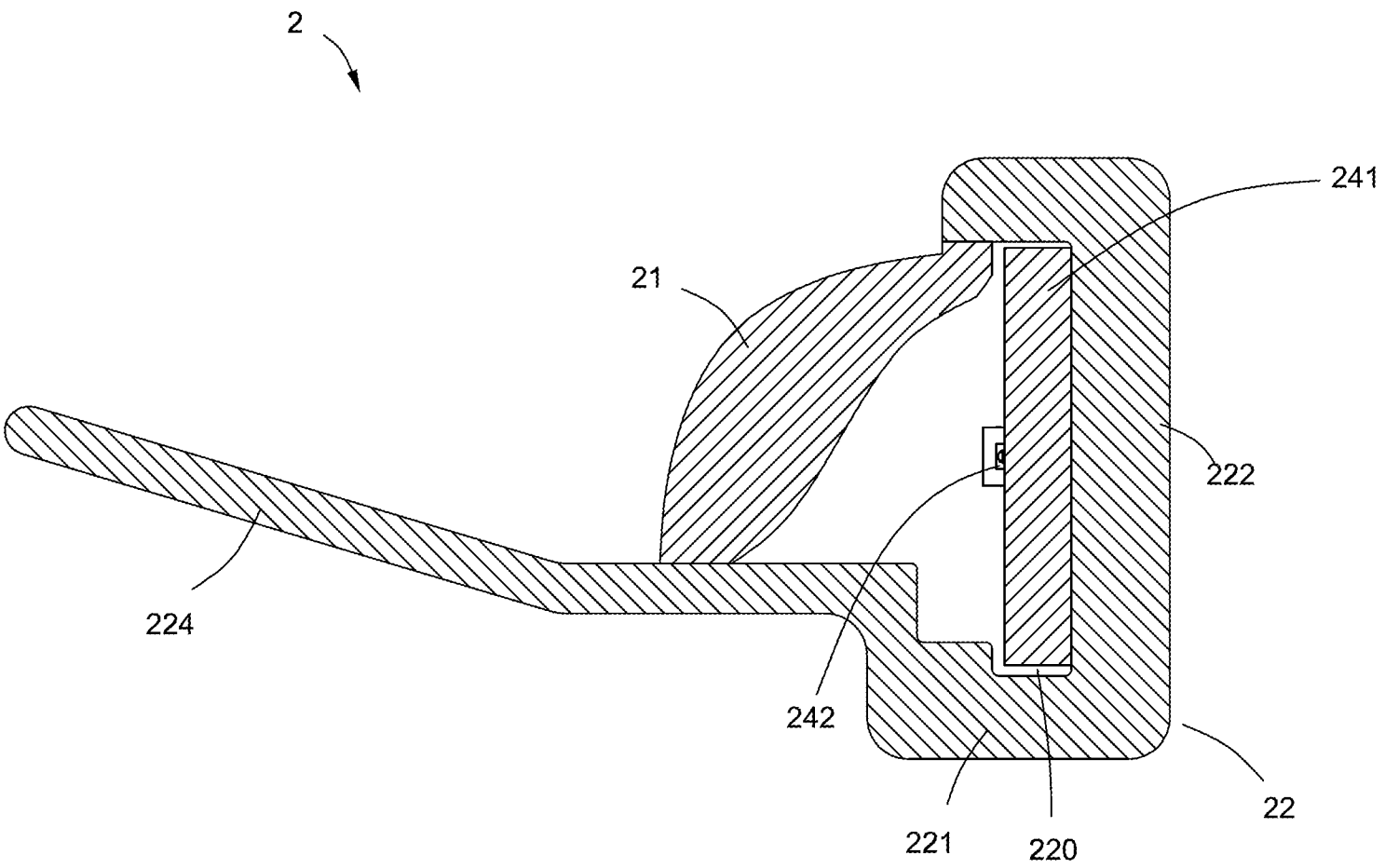
FIG. 8 is a cross-sectional view of the light bar of FIG. 5 taken along the line B-B.

Different from the light bar 1 of the first embodiment, the light bar 2 of the second embodiment has substantially only one half of the light bar 1 of the first embodiment. Referring to FIGS. 6 and 8, in the light bar 2 of the second embodiment, the plurality of LED light sources 242 are mounted on only one side of the substrate 241, and the light emitted from the plurality of LED light sources 242 is irradiated to a predetermined area after passing through the optical component 21.

Figure 7:
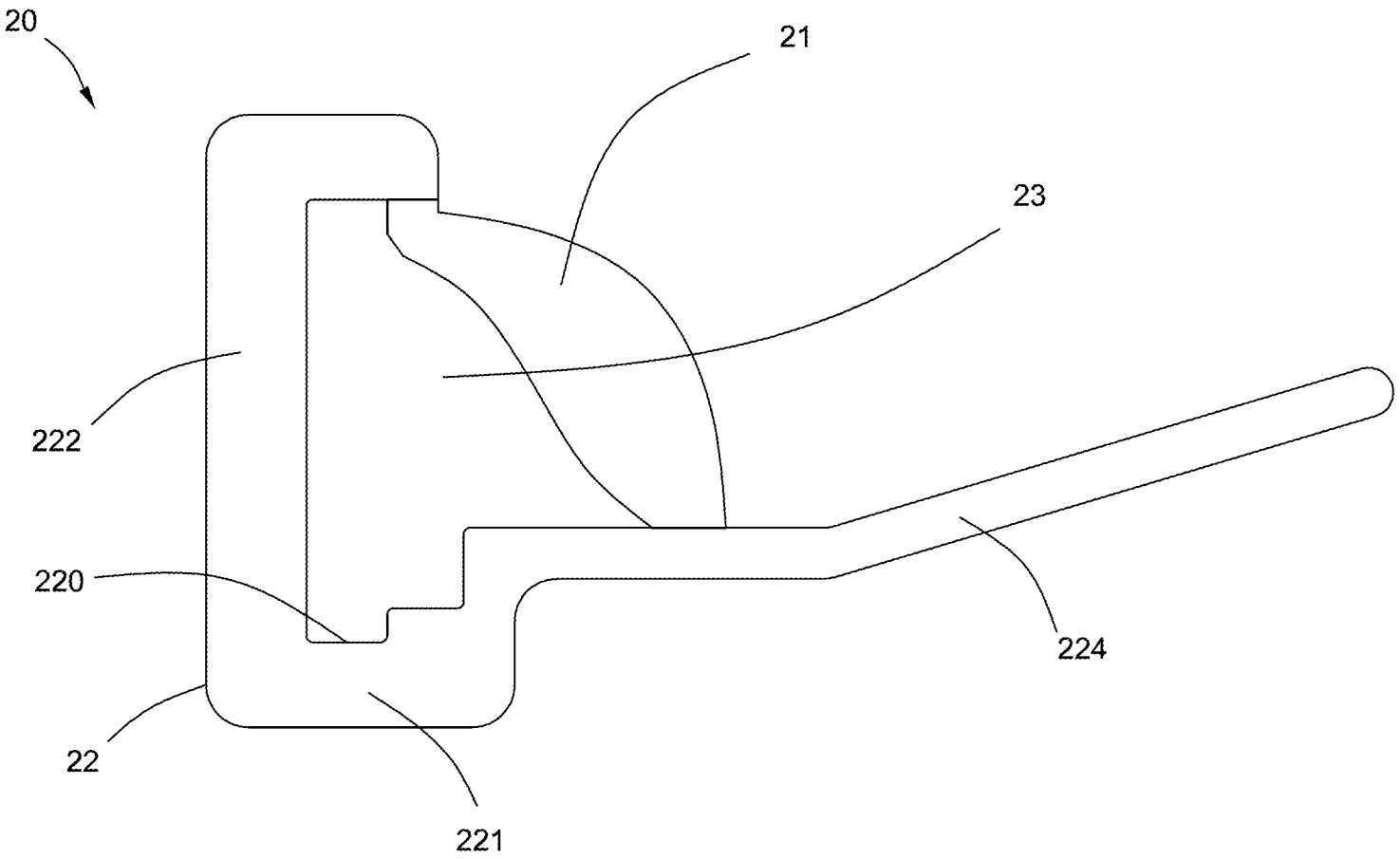
FIG. 7 is an enlarged view of an end portion of a tube of FIG. 6.

With reference to FIGS. 6-8, the housing 22 comprises a mounting wall 221 substantially extending longitudinally and a vertical wall 222 substantially extending vertically from one lateral side of the mounting wall 221. The substrate assembly 24 is installed immediately adjacent to the vertical wall 222 of the housing 22, so the substrate assembly 24 is perpendicular to the mounting wall 221 of the housing 22.

As shown in FIGS. 6-8, the housing 22 defines a longitudinal channel 220 at a junction of the vertical wall 222 and the mounting wall 221. The substrate assembly 24 is slidably mounted in the longitudinal channel 220 of the housing 22 so that the substrate assembly 24 is held in the cavity 23 of the tube 20.

In an optional embodiment, the housing 22 further comprises an anti-dazzle wing 224 extending from an opposite lateral side of the mounting wall 221 beyond the optical component 21. The wing 224 can block light from the optical component 21 to enter eyes of the user who is on the side of the housing 22, which brings the user better visual effects.

With reference to FIG. 6, the light bar 2 further comprises a pair of end caps 26 attached to ends of the tube 20 for sealing the cavity 23. One of the pair of end caps 26 defines a hole (not shown) therein and the wire harness 243 connecting with the substrate 241 extends out of the tube 20 through the hole of the end cap 26. The end cap 26 has a matching structure with the tube 20 so that the light bar 2 has a uniform appearance.

In assembly, the plurality of LED light sources 242 are first mounted on the substrate 241 to form the substrate assembly 24. Then the substrate 241 with the plurality of LED light sources 242, i.e. the substrate assembly 24 is inserted slidably into the longitudinal channel 220 of the housing 22 and is held in the cavity 23 of the tube 20. Finally, the pair of end caps 26 are attached to the ends of the tube 20. The assembly of the light bar 2 is easily finished.

The light bars 1 and 2 of the present invention are simple in structure and easy to assemble and has lower manufacturing cost. Furthermore, the light bars 1 and 2 can adopt multiple low power LED light sources 142 and 242, thereby further reducing product cost.

The light bar 1, 2 of the present invention can be applied to a refrigeration display (not shown). The refrigeration display comprises a plurality of shelves for holding product and at least one mullion having a mounting surface. The vertically extending light bar 1, 2 of the present invention can be positioned within the interior of the refrigeration display behind the at least one mullion and forward of the shelves. The substrate 141, 241 of the light bar 1, 2 is perpendicular to the mounting surface of the at least one mullion. The light emitted from the plurality of LED light sources 142, 242 can be irradiated to the shelves of the refrigeration display after passing through the optical component 11, 21 of the light bar 1, 2.

The light bar 1 of the first embodiment and the light bar 2 of the second embodiment can be used in different cases. When it is required that the light is irradiated to a single direction, the light bar 2 of the second embodiment can be adopted. When it is required that the light is irradiated to opposite two directions, the light bar 1 of the first embodiment can be adopted. Certainly, when the light is not only required to be irradiated to a single direction, but also is required to be irradiated to opposite two directions, the light bar 2 of the second embodiment and the light bar 1 of the first embodiment can be adopted.

For example, in the case that the at least one mullion of the refrigeration display comprises a central mullion, the refrigeration display can use the light bar 1 of the first embodiment. The light bar 1 of the first embodiment is positioned behind the central mullion and forward of the shelves. When the refrigeration display is in operation, the light emitted from the plurality of LED light sources 142 on opposite two sides of the substrate 141 of the light bar 1 can be irradiated to the shelves on two lateral sides of the central mullion.

In the case that the at least one mullion of the refrigeration display comprises a side mullion, the refrigeration display can use the light bar 2 of the second embodiment. The light bar 2 of the second embodiment is positioned behind the side mullion and forward of the shelves. When the refrigeration display is in operation, the light emitted from the plurality of LED light sources 242 on one side of the substrate 241 facing the cavity 23 of the light bar 2 can be irradiated to the shelves on one lateral side of the side mullion.

When the refrigeration display is larger and comprises both the side mullion and the central mullion, such the refrigeration display can adopt both the light bar 1 of the first embodiment and the light bar 2 of the second embodiment.

The light bar 1, 2 of the present invention can distribute the light to a wider display area. Moreover, the light bar 1, 2 of the present invention has a simpler structure and low cost, and is easy to assemble. The light bar 1, 2 of the present invention can widely applied to display cabinets of commercial establishments and has a better market prospect.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A light bar, comprising:

an optical component defining a first longitudinal channel;

a housing for reflecting light, wherein the housing comprises a mounting wall substantially extending longitudinally, wherein the housing defines a second longitudinal channel, and wherein the optical component and the housing together form a tube with a cavity; and a substrate assembly held in the cavity and perpendicularly mounted on the mounting wall in the first longitudinal channel and the second longitudinal channel, wherein the substrate assembly comprises:

a substrate having the shape of a slab; and a plurality of LED light sources mounted on at least one side of the substrate, wherein light emitted from the plurality of LED light sources is irradiated to at least one predetermined area perpendicular to the substrate after passing through the optical component.

2. The light bar of claim 1, wherein the optical component and the housing are integrated together by a co-extrusion or co-injection process.

3. The light bar of claim 1, wherein the substrate assembly is slidably and perpendicularly mounted in the mounting wall of the housing.

4. The light bar of claim 1, wherein the plurality of LED light sources are mounted on opposite two sides of the substrate, and light emitted from the plurality of LED light sources is irradiated to opposite two predetermined areas after passing through the optical component.

5. The light bar of claim 4, wherein the light bar has two halves which are symmetrical relative to the substrate.

6. The light bar of claim 5, wherein the housing further comprises a pair of anti-dazzle wings extending from opposite two lateral sides of the mounting wall beyond the optical component.

7. The light bar of claim 5, wherein the optical component has a substantially dome-shaped cross-section.

8. The light bar of claim 5, wherein each of two halves of the optical component has different thickness.

9. The light bar of claim 1, further comprising a pair of end caps attached to ends of the tube for sealing the cavity.

10. The light bar of claim 9, wherein one of the pair of end caps defines a hole therein and the substrate assembly further comprises a wire harness connecting with the substrate, the wire harness extending out of the tube through the hole.

* * * * *